US008099002B2

(12) United States Patent
Izumi et al.

(10) Patent No.: US 8,099,002 B2
(45) Date of Patent: Jan. 17, 2012

(54) DEVELOPING DEVICE OF IMAGE FORMING APPARATUS USING A TONER AND CARRIER MIXTURE

(75) Inventors: Takao Izumi, Kanagawa (JP); Hiroshi Murata, Kanagawa (JP); Minoru Yoshida, Tokyo (JP); Takashi Hatakeyama, Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 496 days.

(21) Appl. No.: 12/271,478

(22) Filed: Nov. 14, 2008

(65) Prior Publication Data

US 2009/0129792 A1 May 21, 2009

Related U.S. Application Data

(60) Provisional application No. 60/988,362, filed on Nov. 15, 2007.

(51) Int. Cl.
*G03G 15/08* (2006.01)

(52) U.S. Cl. ..... 399/27; 399/29; 399/30

(58) Field of Classification Search ..... 399/29
See application file for complete search history.

(56) References Cited

U.S. PATENT DOCUMENTS

| | | | | |
|---|---|---|---|---|
| 5,771,426 | A * | 6/1998 | Oka et al. | 399/119 |
| 2002/0025178 | A1 * | 2/2002 | Suzuki | 399/30 |
| 2003/0123888 | A1 * | 7/2003 | Naito et al. | 399/27 |
| 2005/0025506 | A1 * | 2/2005 | Adachi | 399/27 |
| 2005/0244172 | A1 * | 11/2005 | Kreckel | 399/27 |
| 2006/0056863 | A1 * | 3/2006 | Murata | 399/27 |
| 2008/0038019 | A1 * | 2/2008 | Kasahara et al. | 399/222 |

FOREIGN PATENT DOCUMENTS

| | | |
|---|---|---|
| JP | 06-348134 | 12/1994 |
| JP | 2001-183893 | 7/2001 |
| JP | 2003-337469 | 11/2003 |

* cited by examiner

*Primary Examiner* — David Gray
*Assistant Examiner* — David Bolduc
(74) *Attorney, Agent, or Firm* — Turocy & Watson, LLP

(57) ABSTRACT

According to an embodiment of the invention, degradation of carrier in a case is detected from the number of rotations of a developing roller. A predetermined quantity of carrier is replenished every time the developing roller reaches a predetermined number of rotations. An excess developer caused by an increase in bulk through carrier replenishment is discharged from a developer discharge port. The degraded old carrier in the case is replaced by new carrier little by little.

12 Claims, 9 Drawing Sheets

FIG. 8

| | PROCESS SPEED | |
|---|---|---|
| | 150mm/s | 75mm/s |
| QUANTITY OF REPLENISHMENT EVERY 13K ROTATIONS | 4g | 6g |

FIG. 9

| | PROCESS SPEED | |
|---|---|---|
| | 150mm/s | 75mm/s |
| QUANTITY OF REPLENISHMENT EVERY 1K PRINTS | 4g | 6g |

FIG. 10

| | PROCESS SPEED | |
|---|---|---|
| PRINT RATE | 150mm/s | 75mm/s |
| 0% OR HIGHER AND LESS THAN 3% | 8g | 10g |
| 3% OR HIGHER AND LESS THAN 6% | 6g | 8g |
| 6% OR HIGHER | 4g | 6g |

| RESTORATION TIME T1 | PROCESS SPEED | |
|---|---|---|
| | 150mm/s | 75mm/s |
| 0 TO LESS THAN 10 SECONDS | 0g | 0g |
| 10 SECONDS OR LONGER AND LESS THAN 40 SECONDS | 4g | 6g |
| 40 SECONDS OR LONGER AND LESS THAN 70 SECONDS | 6g | 8g |
| 70 SECONDS OR LONGER AND LESS THAN 100 SECONDS | 8g | 10g |
| 100 SECONDS OR LONGER | 12g | 14g |
| 130 SECONDS (THRESHOLD) OR LONGER | STOP COLOR PRINTER | |

| | PROCESS SPEED | |
|---|---|---|
| PRINT RATE | 150mm/s | 75mm/s |
| HUMIDITY DIFFERENCE LESS THAN 50% (INITIAL) | 0g | 0g |
| HUMIDITY DIFFERENCE LESS THAN 50% (EVERY 1K) | 4g | 6g |
| HUMIDITY DIFFERENCE 50% OR GREATER (INITIAL) | 12g | 16g |
| HUMIDITY DIFFERENCE 50% OR GREATER (EVERY 1K) | 8g | 10g |

DEVELOPING DEVICE OF IMAGE FORMING APPARATUS USING A TONER AND CARRIER MIXTURE

CROSS-REFERENCE TO RELATED APPLICATION

This application is based upon and claims the benefit of priority from provisional U.S. Application 60/988,362 filed on Nov. 15, 2007, the entire contents of which are incorporated herein by reference.

TECHNICAL FIELD

The present invention relates to an electrophotographic image forming apparatus that carries out development with a two-component developer including toner and carrier and thus provides a toner image.

BACKGROUND

A developing device which is used for an image forming apparatus such as a copy machine or a printer carries out development using a two-component developer. Generally, a developing device using a two-component developer is replenished with toner as it is consumed by development. However, in such a developing device, while the device is replenished with toner, the capability of the carrier is lowered and the capability to charge the toner is deteriorated.

Therefore, conventionally, for example, JP-A-6-348134 discloses a trickle development system to restrain deterioration of the toner charging capability of the carrier. In the trickle development system, a developing container is replenished with new toner and an excess amount of developer is discharged from a discharge port. Thus, the deteriorated carrier is replaced by the new carrier.

However, in the above conventional developing device, the quantity of carrier replenishment into the developing container is decided in accordance with the quantity of consumed toner. Therefore, practically, replenishment with a required quantity of carrier may not be done even though the carrier is seriously deteriorated. If the quantity of carrier replenishment is not enough in this manner, insufficient charging of toner occurs. Consequently, the image quality of the developed toner image may degrade or trouble such as ground fogging may occur. Meanwhile, because of the replenishment with the carrier, the carrier that is not practically deteriorated may be discharged. In this case, the carrier is wasted.

Thus, the developing container is properly replenished with the carrier in accordance with the degradation of the carrier. Consequently, the carrier is not wasted. Also, a sharp developed image is provided and trouble such as ground fogging is prevented to improve the image quality. Development of an image forming apparatus that can realize this is demanded.

SUMMARY

According an aspect of the invention, the developing container is properly replenished with the carrier in accordance with the degradation of the carrier. Insufficient charging of the toner is restrained and the image quality is thus improved. At the same time, wasteful consumption of the carrier is prevented.

According to an aspect of the invention, a developing device includes: a developing container that houses a developer including toner and carrier and discharges the developer from a discharge section; a developing roller that supplies the developer in the developing container to an image carrier; a toner replenishment unit that replenishes the developing container with toner; a carrier replenishment unit that replenishes the developing container with the carrier; a carrying unit that stirs and carries the developer in the developing container; and a control unit that controls quantity of replenishment of the carrier from the carrier replenishment unit in accordance with a change in characteristic of the carrier in the developing container.

DESCRIPTION OF THE DRAWINGS

FIG. 8 is a table showing the quantity of carrier replenishment according to the first embodiment of the invention;

FIG. 9 is a table showing the quantity of carrier replenishment according to a second embodiment of the invention;

FIG. 10 is a table showing the quantity of carrier replenishment according to a third embodiment of the invention;

DETAILED DESCRIPTION

Figure 1:
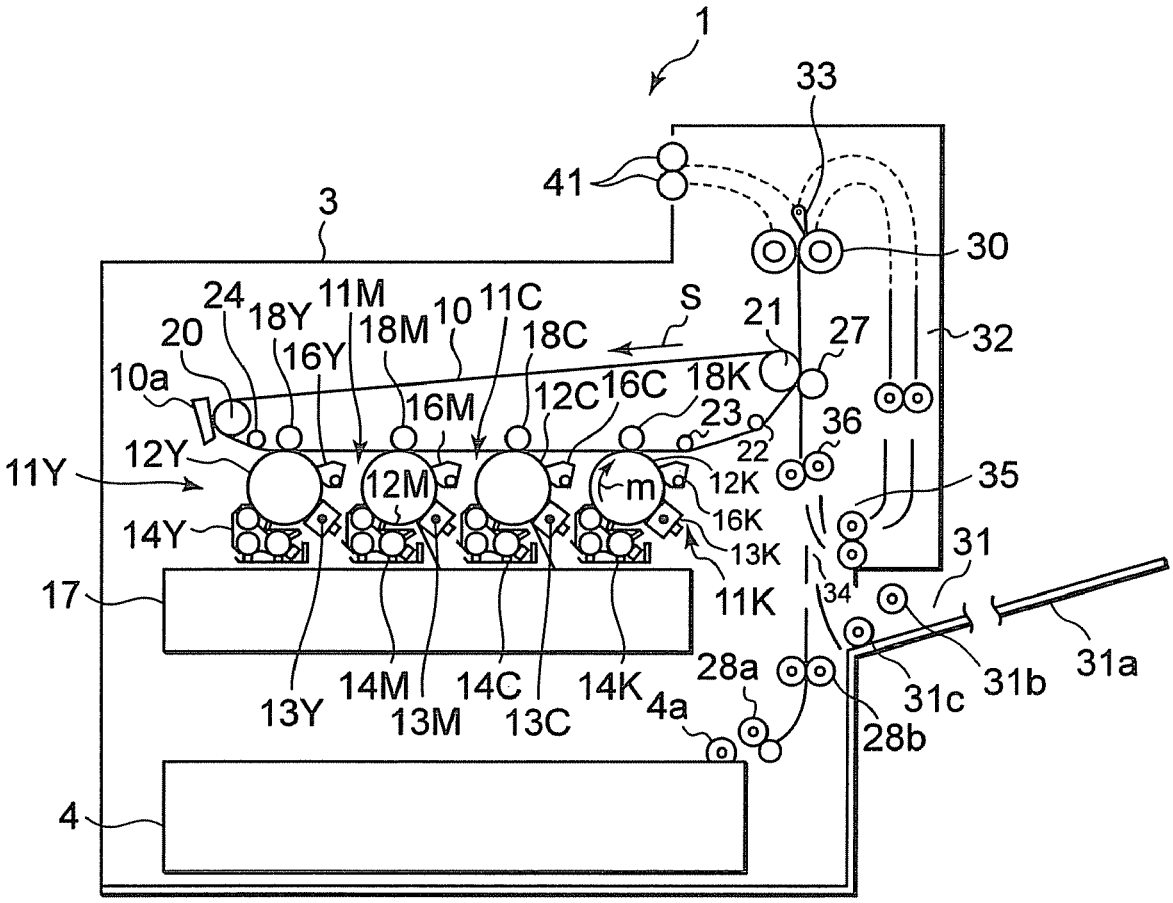
FIG. 1 is a view showing a schematic configuration of a color printer according to a first embodiment of the invention.

Hereinafter, a first embodiment of the invention will be described in detail with reference to the attached drawings. FIG. 1 is a view showing a schematic configuration of a color printer 1, as an image forming apparatus and an apparatus body according to the embodiment of the invention. The color printer 1 has a four-drum tandem system. In forming images, the color printer 1 can switch between two process speeds, for example, the process speed of 150 mm/s and the process speed of 75 mm/s. To switch the process speed, for example, a process speed may be selected on a control panel 8, which will be described later. Alternatively, it is possible to switch the process speed by setting monochrome image formation or color image formation.

The color printer 1 has a paper discharge unit 3 in its upper part. The color printer 1 has an image forming unit 11 below an intermediate transfer belt 10. The image forming unit 11 has four process units 11Y, 11M, 11C and 11K arranged parallel to each other along the intermediate transfer belt 10. The process units 11Y, 11M, 11C and 11K form toner images of yellow (Y), magenta (M), cyan (C) and black (K), respectively.

Figure 2:
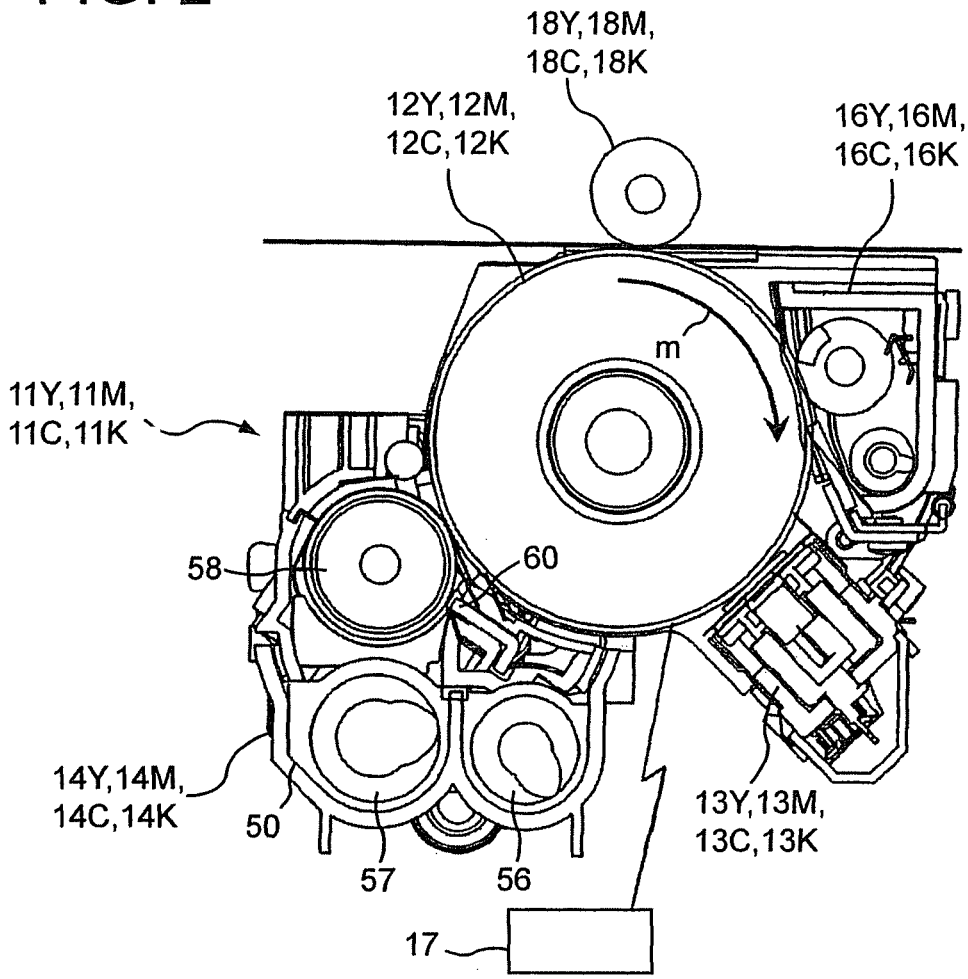
FIG. 2 is a view showing a schematic configuration of a process unit according to the first embodiment of the invention.
Figure 3:
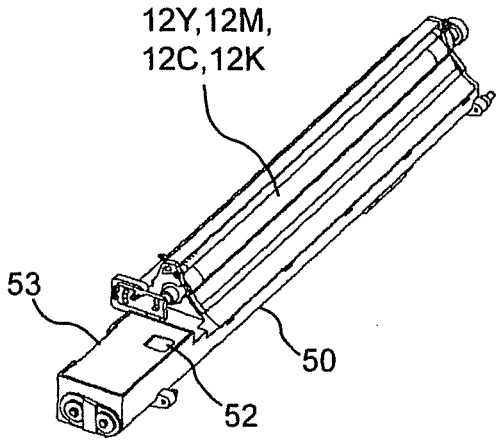
FIG. 3 is a schematic perspective view showing a developing device according to the first embodiment of the invention.

The respective process units 11Y, 11M, 11C and 11K have photoconductive drums 12Y, 12M, 12C and 12K as image carriers, respectively, as shown in FIG. 2. The respective photoconductive drums 12Y, 12M, 12C and 12K can rotate in the direction of arrow m. The rotation speed of the respective photoconductive drums 12Y, 12M, 12C and 12K can be switched by the switching of the process speed of the color printer 1. Chargers 13Y, 13M, 13C and 13K, developing devices 14Y, 14M, 14C and 14K, and photoconductor cleaners 16Y, 16M, 16C and 16K are arranged, respectively, along the rotating direction around the respective photoconductive drums 12Y, 12M, 12C and 12K. The respective chargers 13Y, 13M, 13C and 13K uniformly and negatively (−) charge the respective photoconductive drums 12Y, 12M, 12C and 12K, respectively.

In the space from the chargers 13Y, 13M, 13C and 13K to the developing devices 14Y, 14M, 14C and 14K around the respective photoconductive drums 12Y, 12M, 12C and 12K, exposure light for each color is cast from a laser exposure device 17. Thus, an electrostatic latent image is formed on each of the photoconductive drums 12Y, 12M, 12C and 12K. The respective chargers 13Y, 13M, 13C and 13K and the laser exposure device 17 constitute a latent image forming section.

The respective developing devices 14Y, 14M, 14C and 14K develop the electrostatic latent images on the photoconductive drums 12Y, 12M, 12C and 12K. The respective developing devices 14Y, 14M, 14C and 14K carry out development using a two-component developer including each toner, that is, developer of yellow (Y), magenta (M), cyan (C) or black (K), and carrier.

The intermediate transfer belt 10 is tensioned across a backup roller 21, a driven roller 20 and first to third tension rollers 22 to 24, and is turned in the direction of arrow s. The turning speed of the intermediate transfer belt 10 can be switched by the switching of the process speed of the color printer 1.

The intermediate transfer belt 10 faces and contacts the photoconductive drums 12Y, 12M, 12C and 12K. Primary transfer rollers 18Y, 18M, 18C and 18K are provided at the positions where the intermediate transfer belt 10 faces photoconductive drums 12Y, 12M, 12C and 12K. The respective primary transfer rollers 18Y, 18M, 18C and 18K carry out primary transfer of toner images formed on the respective photoconductive drums 12Y, 12M, 12C and 12K, respectively, to the intermediate transfer belt 10.

The respective photoconductor cleaners 16Y, 16M, 16C and 16K eliminate the remaining electric charges on the surface of the respective photoconductive drums 12Y, 12M, 12C and 12K, respectively, after primary transfer. The respective photoconductor cleaners 16Y, 16M, 16C and 16K also remove and collect the remaining toner on the respective photoconductive drums 12Y, 12M, 12C and 12K.

A secondary transfer roller 27 is arranged in a secondary transfer section, which is the transfer position on the intermediate transfer belt 10 supported by the backup roller 21. In the secondary transfer section, a predetermined secondary transfer bias is applied to the backup roller 21. When a paper sheet passes between the intermediate transfer belt 10 and the secondary transfer roller 27, the toner image on the intermediate transfer belt 10 is secondary-transferred to the paper sheet. The paper sheet P is supplied from a paper feed cassette 4 or a manual insertion mechanism 31. After the end of secondary transfer, the intermediate transfer belt 10 is cleaned by a belt cleaner 10*a*.

A pickup roller 4*a*, a separation roller 28*a*, a pair of carrying rollers 28*b* and a pair of registration rollers 36 are provided in a space from the paper feed cassette 4 to the secondary transfer roller 27. A manual insertion pickup roller 31*b* and a manual insertion separation roller 31*c* are provided in a space from a manual insertion tray 31*a* of the manual insertion mechanism 31 to the pair of registration rollers 36. Moreover, a fixing device 30 is provided downstream of the secondary transfer section, along the direction of a vertical carrying path 34. The fixing device 30 fixes the toner image transferred to the paper sheet P in the secondary transfer section, to the paper sheet P. A gate 33 that allocates the paper sheet into the direction of paper discharge rollers 41 or into the direction of a re-carrying unit 32 is provided downstream of the fixing device 30. The paper sheet guided to the paper discharge rollers 41 is discharged to the paper discharge unit 3. The paper sheet guided to the re-carrying unit 32 is guided again to the direction of the secondary transfer roller 27. The rotation speed of the respective primary transfer rollers 18Y, 18M, 18C and 18K, the secondary transfer roller 27 and the fixing device 30 can be switched by the switching of the process speed of the color printer 1.

Next, the developing devices 14Y, 14M, 14C and 14K will be described in detail with reference to FIG. 3 to FIG. 7. Since developing devices 14Y, 14M, 14C and 14K have the same structure, common reference numerals will be used for explanation. Each of the developing devices 14Y, 14M, 14C and 14K has a case 50 as a developing container, a developing roller 58, a first screw 56 and a second screw 57, which constitute a carrying unit, a regulating blade 60, and a toner concentration sensor 61 serving as a carrier degradation detection unit and as a toner concentration detection unit.

Figure 7:
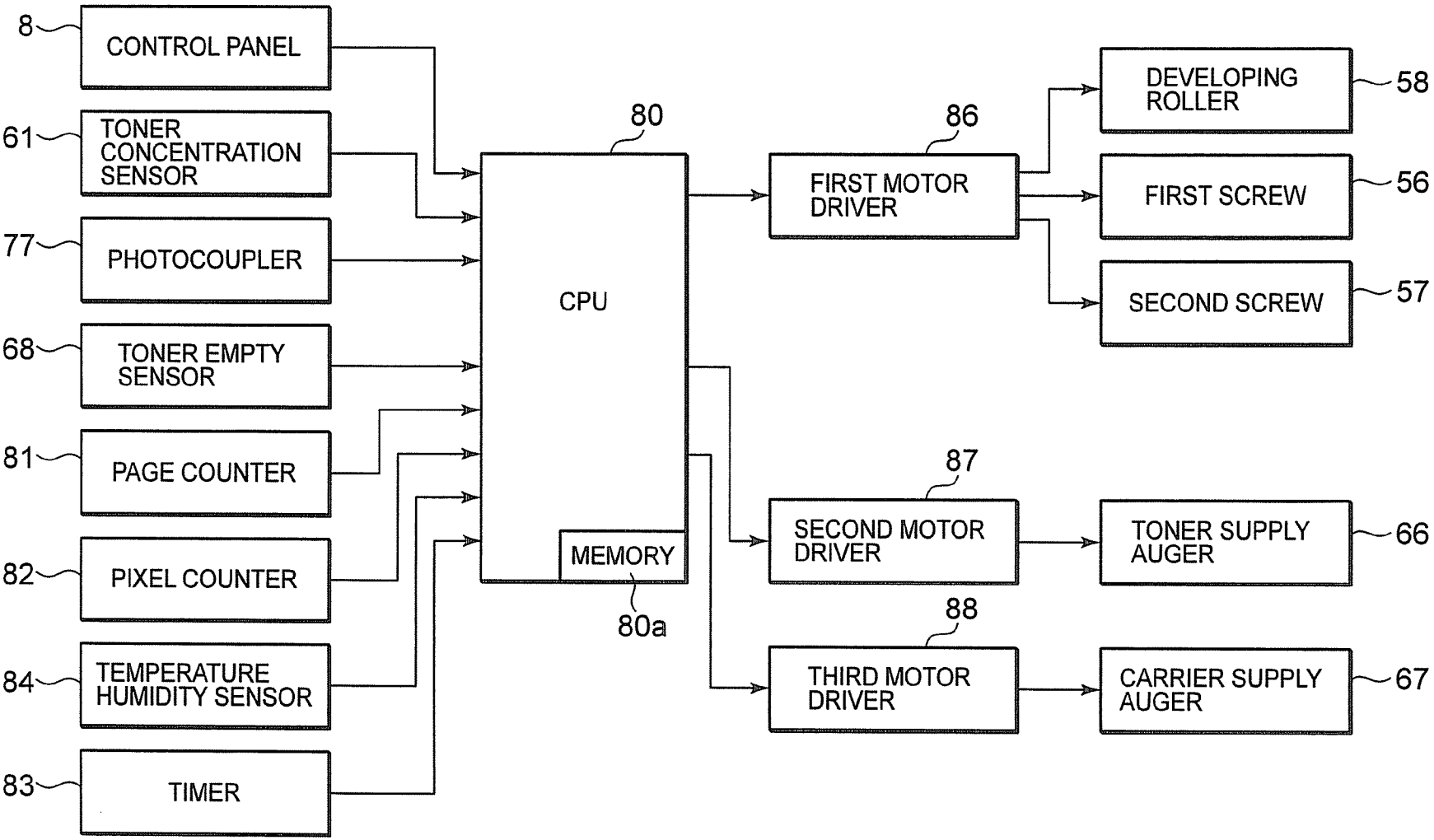
FIG. 7 is a block diagram of a control system having the developing device as its main component according to the first embodiment of the invention.

FIG. 7 is a block diagram of a control system that controls replenishment of the respective developing devices 14Y, 14M, 14C and 14K with new carrier. To the input side of a CPU 80 as a control unit that controls the entire color printer 1 and controls the quantity of replenishment with carrier, a control panel 8, a toner concentration sensor 61, a toner empty sensor 68 which detects that a toner cartridge 63 is empty, a photocoupler 77 that detects the number of rotations of the developing roller 58, a page counter 81 that cumulatively counts the number of prints (number of print pages) in the color printer 1, a pixel counter 82 for detecting the print rate of an image, a timer 83, and a temperature humidity sensor 84 are connected.

First to third motor drivers 86 to 88 are connected to the output side of the CPU 80. The first motor driver 86 drives the developing roller 58, the first screw 56 and the second screw 57. The second motor driver 87 drives a toner supply auger 66. The third motor driver 88 drives a carrier supply auger 67. When the process speed of the color printer 1 is switched, the first motor driver 86 switches the driving speed of the developing roller 58, the first screw 56 and the second screw 57.

The case 50 houses a developer 51 having toner and carrier. The developers 51 in the respective developing devices 14Y, 14M, 14C and 14K have different colors from each other. On top of the front side of the case 50, a developer replenishment port 52 is formed. On the front side of the case 50, a developer replenishment unit 62 is provided. The developer replenishment unit 62 has a toner cartridge 63 and a carrier cartridge 64 in an integrated manner. The toner cartridge 63 is a toner replenishment unit and houses new toner for replenishment. The carrier cartridge 64 is a carrier replenishment unit and houses new carrier for replenishment. The toner supply auger 66, which supplies new toner to the developer replenishment port 52, is provided on the bottom of the toner cartridge 63. The carrier supply auger 67, which supplies new carrier to the developer replenishment port 52, is provided on the bottom of the carrier cartridge 64.

The toner supply auger 66 rotates to supply a predetermined quantity of toner in accordance with the result of detection by the toner concentration sensor 61. The carrier supply auger 67 rotates to supply a predetermined quantity of carrier in accordance with a change in characteristics of the developer 51 in the case 50. The regulating blade 60 controls the height of the two-component developer to a substantially uniform level.

The toner concentration sensor 61 is arranged below and on the rear side of the first screw 56. It is preferable that the toner concentration sensor 61 is arranged away from the developer replenishment port 52 in the case 50. Such an arrangement enables improvement in accuracy of the toner concentration sensor 61 in measuring the toner concentration of the developer 51. For example, a magnetic permeability sensor or the like is used for the toner concentration sensor 61. The result of detection, which is the output from the toner concentration sensor 61, is expressed as a voltage value. If the toner concentration of the developer 51 in the case 50 is changed, the output value of the toner concentration sensor 61 changes. Also, if the quantity of toner charging of the developer 51 is changed, the output value of the toner concentration sensor 61 changes.

When the toner concentration of the developer 51 in the case 50 is lowered, the toner concentration sensor 61 inputs the result of detection to the CPU 80. The CPU 80 drives the toner supply auger 66 in accordance with the result of detection and thus allows the toner cartridge 63 to be replenished with new toner. Thus, the toner concentration of the developer 51 in the case 50 is maintained at a constant level.

At a side part on the front side of the case 50, a developer discharge port 53 as a discharge section is formed. An excess amount of developer caused by the increased bulk in the case 50 is discharged and collected from the developer discharge port 53. Thus, the quantity of the developer 51 is maintained at a constant level in the case 50. At the same time, in the case 50, degraded old carrier of the developer 51 is replaced by new carrier little by little.

The developing roller 58 is rotatably provided in the case 50. The developing roller 58 supplies toner to the electrostatic latent images formed on the respective photoconductive drums 12Y, 12M, 12C and 12K and thus forms toner images. The inside of the case 50 is divided by a partition 70 along the axial direction of the respective photoconductive drums 12Y, 12M, 12C and 12K. The inside of the case 50 is divided by the partition 70 into a stir-carrying chamber 71 and a stir-supply chamber 72. In the stir-carrying chamber 71, new toner and new carrier supplied from the developer replenishment port 52 and the developer 51 in the case 50 are stirred and carried in the direction of arrow x by the first screw 56. This causes the toner of the developer 51 to be charged.

The developer 51, stirred and carried by the first screw 56, is supplied to the stir-supply chamber 72 through a first connecting part 73 on the rear side of the partition 70. In the stir-supply chamber 72, the developer 51 is stirred and carried in the direction of arrow y by the second screw 57 and is supplied to the developing roller 58.

Figure 4:
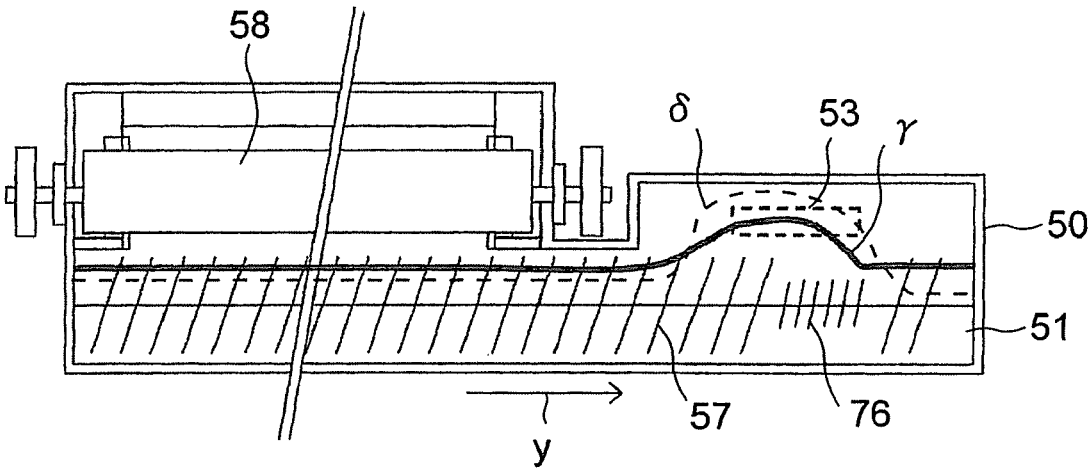
FIG. 4 is a schematic explanatory view showing the developer level on the second screw side according to the first embodiment of the invention.
Figure 5:
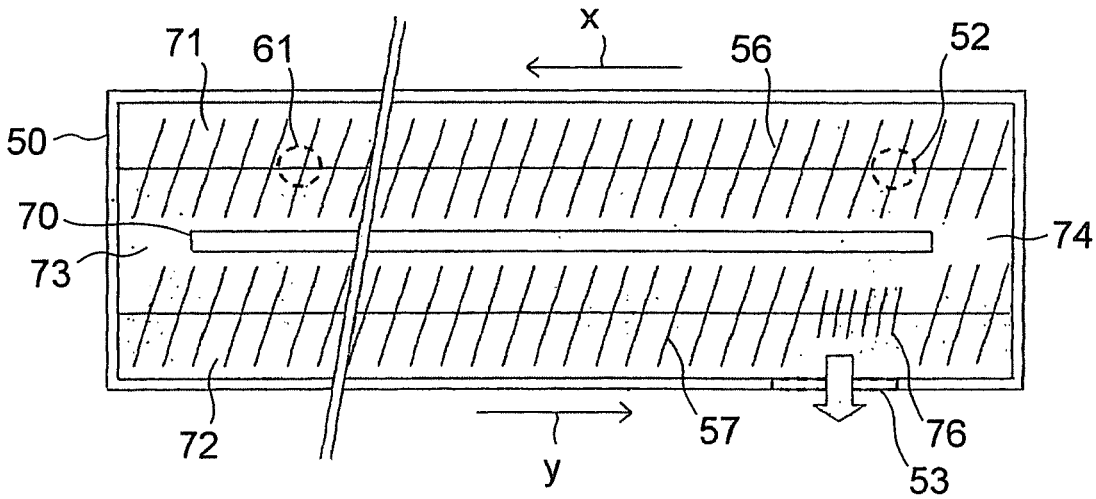
FIG. 5 is a schematic explanatory view showing the flow of developer in a case according to the first embodiment of the invention.
Figure 6:
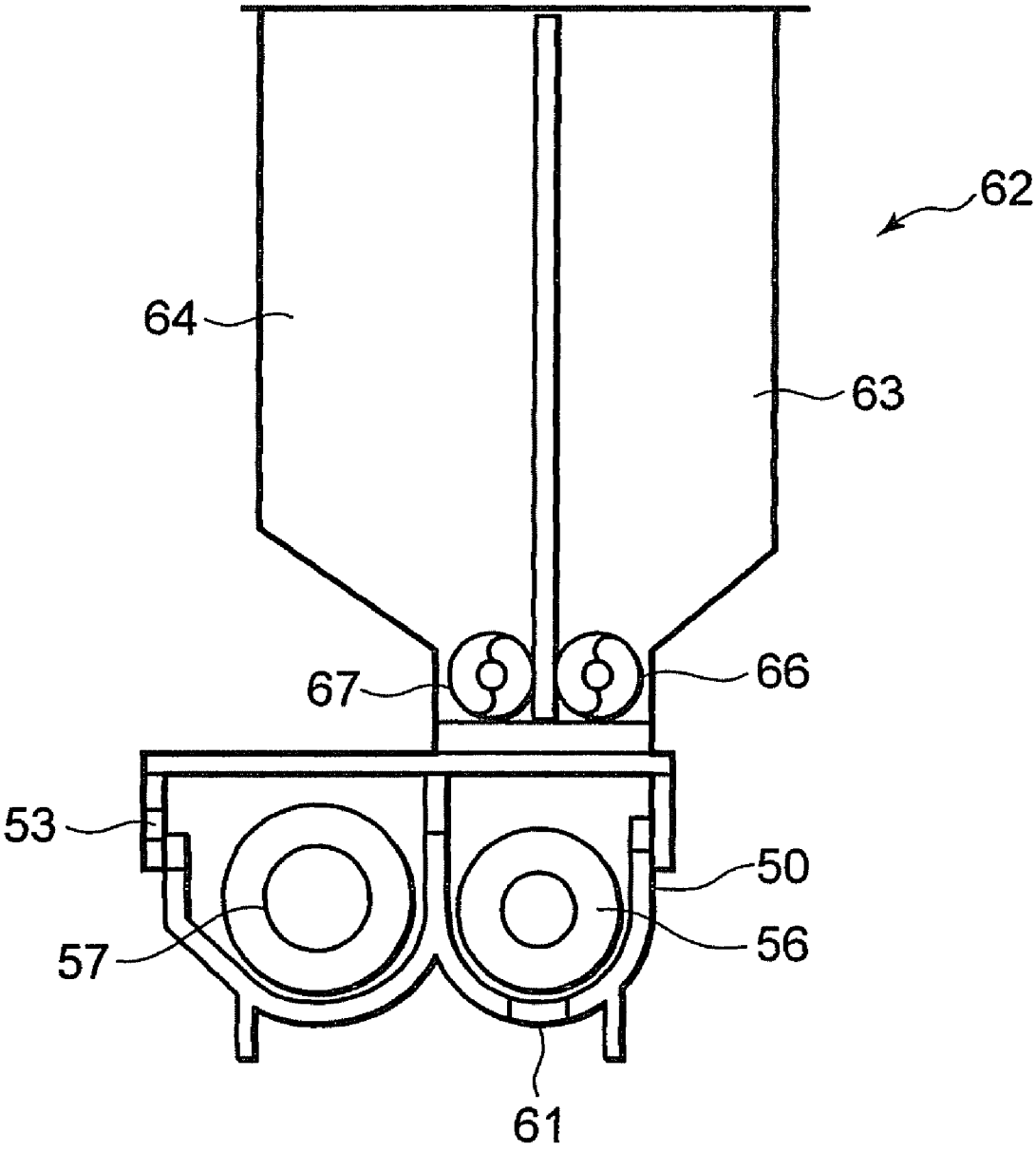
FIG. 6 is a schematic explanatory view showing a developer replenishment unit according to the first embodiment of the invention.

A discharge screw 76 is formed on the front side of the second screw 57. The discharge screw 76 has a smaller screw diameter and a narrower screw pitch, as shown in FIG. 4, and thus decelerates the flow rate of the developer 51. Thus, the surface of the developer 51 carried in the direction of arrow y is raised into a hill-like shape, as indicated by solid line γ. When the bulk of the developer 51 is a predetermined quantity, the developer 51 does not reach the height of the developer discharge port 53 even if the developer 51 is raised by the discharge screw 76. If carrier is replenished from the carrier cartridge 64 in this state, the bulk of the developer 51 increases. Thus, the developer 51 raised by the discharge screw 76 reaches the height of the developer discharge port 53. The developer 51 reaching the developer discharge port 53 is discharged from the developer discharge port 53. The developer discharge port 53 is arranged in such a manner that the peak of the hill of the developer 51 raised by the discharge screw 76 coincides with a substantially central part in the longitudinal direction of the developer discharge port 53. Thus, discharge from the developer discharge port 53 of the excess developer equivalent to the increase in the bulk by replenishment with the carrier is stabilized. The developer 51 which passed through the discharge screw 76 is circulated and carried into the stir-carrying chamber 71 through a second connecting part 74 on the front side of the partition 70.

The height of the surface of the developer 51 stirred and carried by the first screw 56, the second screw 57 and the discharge screw 76 is changed by the switching of the process speed. For example, it is now assumed that the height of the surface of the developer 51 is shown by solid line γ when the process speed is 150 mm/s. Then, if the process speed is switched to 75 mm/s, the height of the surface of the developer 51 is changed as indicated by broken line δ. That is, if the process speed is changed from high speed to low speed, the toner charging power is weakened and therefore the overall bulk of the developer 51 is reduced. Meanwhile, since the flow rate of the developer 51 is further lowered by the discharge screw 76, the quantity of the developer 51 raised into a hill-like shape increases. As a result, the quantity of the developer discharged from the developer discharge port 53 increases. Because of this reduction in the overall bulk of the developer 51 and the increase in the quantity of discharged developer, the height of the surface of the developer 51 is lowered.

In the color printer 1 configured as described above, while an image is formed, the case 50 of each of the developing devices 14Y, 14M, 14C and 14K is replenished with new toner from the toner cartridge 63 in accordance with the result of detection by the toner concentration sensor 61. The case 50 of each of the developing devices 14Y, 14M, 14C and 14K is also replenished with carrier from the carrier cartridge 64 in accordance with degradation of the carrier of the developer 51.

Next, replenishment of the case 50 with new carrier will be described in detail. In this first embodiment, degradation of the carrier is detected by using the number of rotations of the developing roller 58. Stress is applied to the carrier in the case 50 when the carrier passes through the regulating blade 60 or when the carrier is stirred by the first and second screws 56 and 57. As this stress is applied more frequently, the carrier is degraded. Its coating may peel off, or a toner spent phenomenon, that is, contamination with toner, may occur. This degradation of the carrier deteriorates the toner charging capability and hence the capability of the developer 51. The developer 51 eventually reaches its life span.

In this embodiment, the number of rotations of the developing roller 58 and hence the number of rotations of the first and second screws 56 and 57 are detected. The frequency of stress applied to the carrier is thus detected and the degraded carrier is replaced by new carrier. Degradation of the carrier is thus restrained.

While an image is formed by the color printer 1, the number of rotations of the developing roller 58 is detected by the photocoupler 77 and inputted to the CPU 80. In accordance with the result of detection by the photocoupler 77, the CPU 80 controls the third motor driver 88 when the developing roller 58 reaches a predetermined number of rotations. The third motor driver 88 drives the carrier supply auger 67 by a predetermined amount so that the case 50 is replenished with a predetermined quantity of carrier from the carrier cartridge 64.

For example, it is now assumed to be known that, where the volume of the developer in the case 50 is 400 g, the developer reaches its life span as the developing roller 58 rotates 1300 kilo. In this case, if the process speed is 150 mm/s, the carrier is replenished in the quantity of replenishment shown in FIG. 8. That is, every time the developing roller 58 rotates 13 kilo, 4 grams of carrier is replenished.

As the carrier is replenished from the developer replenishment port 52 at the rate of 4 g/13 kilo rotations, the bulk of the developer 51 in the case 50 is increased. When the bulk of the developer 51 is thus increased, the developer 51 raised by the discharge screw 76 reaches the developer discharge port 53 as indicated by solid line γ in FIG. 4. The excess developer reaching the developer discharge port 53 is discharged from the developer discharge port 53. The discharged developer includes degraded old carrier. The developer 51 in the case 50 contains 4 g of new carrier by replacement. Thus, degradation of the carrier in the case 50 of each of the developing devices 14Y, 14M, 14C and 14K is restrained. Consequently, the carrier can constantly maintain good properties and is capable of charging toner sufficiently.

Meanwhile, if the process speed is reduced to 75 mm/s while an image is formed, the quantity of carrier replenishment is increased, compared to the case of high speed. This compensates for the reduction in the bulk of the developer 51 due to the reduction in the number of rotations of the discharge screw 76 and hence the increase of the developer discharged from the developer discharge port 53. This also compensates for the lowering of the surface of the developer 51 due to the reduction in the number of rotations of the first screw 56 and the second screw 57 and hence the reduction of toner charging.

When the process speed is reduced to 75 mm/s, every time the developing roller 58 rotates 13 kilo, the carrier is replenished at the rate of 6 g to increase the bulk of the developer 51 in the case 50, as shown in FIG. 8. Thus, the lowering of the surface of the developer 51 due to the reduction in the process speed is restrained. As the carrier is replenished at the rate of 6 g/13 kilo rotations, the bulk of the developer 51 in the case 50 is increased. When the developer 51 in the case 50 becomes excessive, the developer is discharged from the developer discharge port 53.

According to the first embodiment, the number of rotations of the developing roller 58 is detected and thereby degradation of the carrier in the case 50 is detected. Then, replenishment with a predetermined quantity of carrier is done in accordance with the number of rotations of the developing roller 58. The excess developer caused by the increase in the bulk is discharged from the developer discharge port 53. Thus, the degraded old carrier in the case 50 is replaced by new carrier little by little. Therefore, in the respective developing devices 14Y, 14M, 14C and 14K, the carrier can constantly maintain good properties. Consequently, the toner of the developer 51 is sufficiently charged by the carrier. The respective developing devices 14Y, 14M, 14C and 14K can form high-quality developed images. Moreover, carrier replenishment is properly done in response to deterioration of capability in accordance with the number of rotations of the developing roller 58, and a proper quantity of carrier is replaced. The existing carrier which is not degraded does not replenishment with new carrier, and wasteful discharge of the non-degraded carrier from the developer discharge port 53 can be prevented. As a result, usable carrier is not discharged from the case 50 and wasteful consumption of the carrier can be avoided.

Next, a second embodiment of the invention will be described. This second embodiment differs from the above first embodiment in the method of detecting carrier degradation. In this embodiment, the number of image forming pages or the number of image forming sheets on which images are formed by the color printer 1 is detected and degradation of the carrier in the case 50 is thus detected. The other parts are similar to those of the first embodiment. Therefore, the same configuration as the configuration described in the first embodiment is denoted by the same reference numerals and will not be described further in detail.

While an image is formed by the color printer 1, the page counter 81 cumulatively counts and inputs the number of image forming sheets to the CPU 80. When the result of detection by the page counter 81 reaches a predetermined number of image forming sheets, the CPU 80 controls the third motor driver 88. The third motor driver 88 drives the carrier supply auger 67 by a predetermined quantity so that the case 50 is replenished with a predetermined quantity of the carrier from the carrier cartridge 64.

For example, it is now assumed to be known that, where the volume of the developer in the case 50 is 400 g, the developer reaches its life span as the number of print sheets reaches 100 kilo sheets. In this case, if the process speed is 150 mm/s, the carrier is replenished in the quantity of replenishment shown in FIG. 9. That is, every time the number of print sheets printed by the color printer 1 reaches 1000, 4 grams of carrier is replenished.

By the amount of increase in the bulk due to the replenishment with the carrier, the excess developer is discharged from the developer discharge port 53. The developer 51 in the case 50 contains 4 g of new carrier by replacement. Thus, degradation of the carrier in the case 50 of each of the developing devices 14Y, 14M, 14C and 14K is restrained. Consequently, the carrier can constantly maintain good properties and is capable of charging toner sufficiently.

Meanwhile, if the process speed is reduced to 75 mm/s, every time the number of print sheets printed by the color printer 1 reaches 1000, the carrier is replenished at the rate of 6 g, as shown in FIG. 9. This compensates for the reduction in the bulk of the developer 51 due to the deceleration, compared to the case of high speed.

According to the second embodiment, the number of print sheets printed by the color printer 1 is detected and thereby degradation of the carrier in the case 50 is detected. Then, replenishment with a predetermined quantity of carrier is done in accordance with the number of print sheets printed by the color printer 1. The excess developer caused by the increase in the bulk is discharged from the developer discharge port 53. Thus, the degraded old carrier in the case 50 is replaced by new carrier little by little. Consequently, as in the first embodiment, the carrier can constantly maintain good properties in the respective developing devices 14Y, 14M, 14C and 14K. Therefore, the toner of the developer 51 is sufficiently charged by the carrier. The respective developing devices 14Y, 14M, 14C and 14K can form high-quality developed images. Moreover, the carrier is properly replaced in response to deterioration of capability. The existing carrier which is not degraded does not replenishment with new carrier, and wasteful discharge of usable carrier from the developer discharge port 53 can be prevented. Wasteful consumption of the carrier can be avoided.

Next, a third embodiment of the invention will be described. This third embodiment differs from the above first embodiment in the method of detecting carrier degradation. In this embodiment, the print rate in image formation by the color printer 1 is detected, in addition to the first embodiment or the second embodiment, and degradation of the carrier in the case 50 is thus detected. The other parts are similar to those of the first embodiment or the second embodiment. Therefore, the same configuration as the configuration described in the first embodiment or the second embodiment is denoted by the same reference numerals and will not be described further in detail.

While an image is formed by the color printer 1, the pixel counter 82 cumulatively counts and inputs the number of printed pixels to the CPU 80. Every time the number of rotations of the developing roller 58 reaches 13 kilo rotations, the CPU 80 refers to the result of detection by the pixel counter 82, further. Alternatively, every time the number of print sheets printed by the color printer 1 reaches 100 kilo sheets, the CPU 80 refers to the result of detection by the pixel counter 82, further.

In accordance with the result of detection by the pixel counter 82, a normal quantity of carrier is replenished when the cumulative count value of printed pixels is within a predetermined range. When the cumulative count value of printed pixels is greater than a predetermined value, a smaller quantity of carrier than normal is replenished. When the cumulative count value of printed pixels is smaller than a predetermined value, a greater quantity of carrier than normal is replenished. Even when the number of rotations of the developing roller or the number of print sheets is the same, if the print rate is lower, replacement of the toner in the case 50 is less. Therefore, in the case 50, the same toner contacts the carrier many times. Consequently, the carrier tends to degrade because of toner spent.

For example, it is now assumed that, in the second embodiment above, 400 g of developer in the case 50 reaches its life span at the print rate of 6% and the number of print sheets of 100 kilo. In this case, every time the number of print sheets reaches 1000, the average print rate is calculated from the cumulative count value of the pixel counter 82. As shown in FIG. 10, if the process speed is 150 mm/s and the average print rate is 6% or higher, the carrier is replenished at the rate of 4 g every time the number of print sheets reaches 1000. If the average print rate is 3% or higher and less than 6%, the carrier is replenished at the rate of 6 g every time the number of print sheets reaches 1000. If the average print rate is 0% or higher and less than 3%, the carrier is replenished at the rate of 8 g every time the number of print sheets reaches 1000. By the amount of increase in the bulk due to the replenishment with the carrier, the excess developer is discharged from the developer discharge port 53. The developer 51 in the case 50 contains new carrier in the quantity corresponding to the quantity of replenishment. Thus, in the respective developing devices 14Y, 14M, 14C and 14K, the carrier can constantly maintain good properties and is capable of charging toner sufficiently.

Meanwhile, if the process speed is reduced to 75 mm/s, and if the average print rate is 6% or higher, the carrier is replenished at the rate of 6 g every time the number of print sheets reaches 1000, for example, as shown in FIG. 10. If the average print rate is 3% or higher and less than 6%, the carrier is replenished at the rate of 8 g every time the number of print sheets reaches 1000. If the average print rate is 0% or higher and less than 3%, the carrier is replenished at the rate of 10 g every time the number of print sheets reaches 1000. This compensates for the reduction in the bulk of the developer 51 due to the deceleration, compared to the case of high speed. In the first embodiment, the quantity of carrier replenishment can be set further in consideration of print rate.

According to the third embodiment, the print rate is further considered as well as the number of rotations of the developing roller 58 in the first embodiment, or the printer rate is further considered as well as the number of print sheets in the second embodiment, and thereby degradation of the carrier in the case 50 is detected. Therefore, degradation of the carrier can be detected with higher accuracy. Replenishment with carrier is done in accordance with the highly accurate detection result. The old carrier is replaced by new carrier little by little. Consequently, in the respective developing devices 14Y, 14M, 14C and 14K, degradation of the carrier in the case 50 is restrained further. The carrier can constantly maintain better properties and is capable of charging toner sufficiently. The respective developing devices 14Y, 14M, 14C and 14K can form better toner images. Moreover, as carrier degradation is detected more accurately, wasteful discharge of usable carrier from the developer discharge port 53 can be prevented more securely.

Next, a fourth embodiment of the invention will be described. In this fourth embodiment, the quantity of carrier replenishment according to the first or the second embodiment is adjusted further in response to degradation of the carrier. In this embodiment, the same configuration as the configuration described in the first or the second embodiment is denoted by the same reference numerals and will not be described further in detail.

In this embodiment, when degradation of the carrier in the case 50 proceeds and reaches a high degree of degradation, the quantity of carrier replenishment is increased and the bulk of the developer 51 is thus increased. This increases the quantity of the developer discharged from the developer discharge port 53. Consequently, the quantity of replaced carrier is increased and the degree of degradation is improved.

In this embodiment, a table that sets the quantity of carrier replenishment in accordance with the degree of carrier degradation is stored in the memory 80*a* of the CPU 80. Meanwhile, the degree of carrier degradation in the case 50 is detected and the result of detection is compared with the table in the memory 80*a*. The quantity of carrier replenishment is thus decided.

Figures 11, 12:
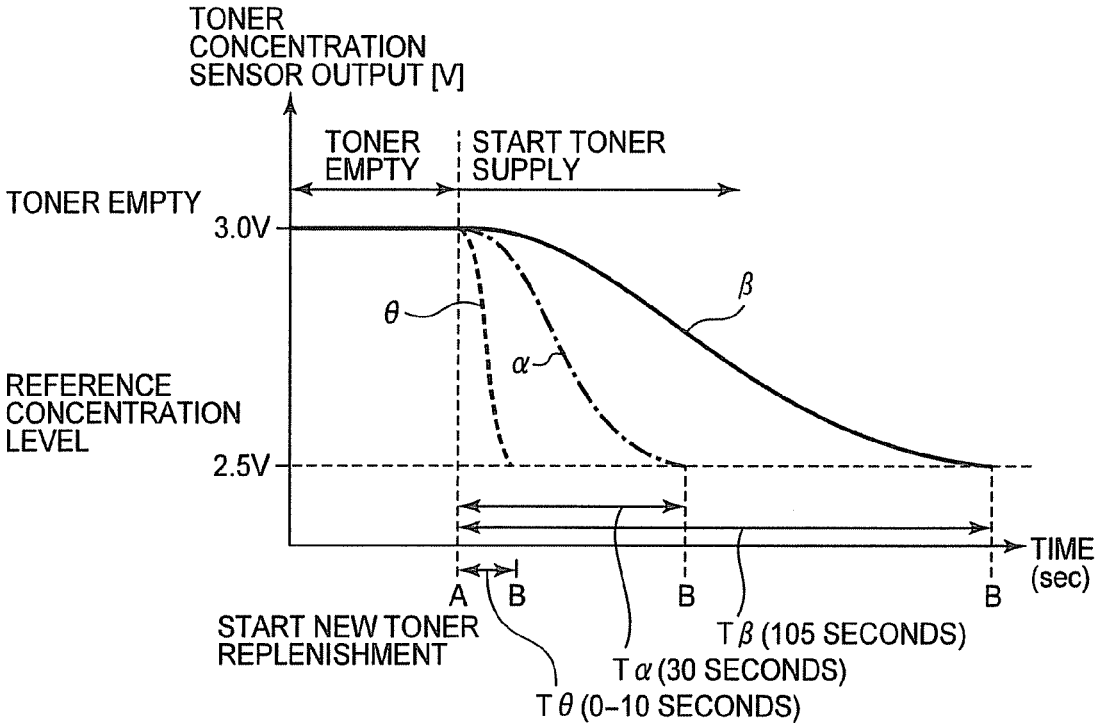
FIG. 11 is a graph showing time when a developer having a predetermined degree of degradation restores a reference concentration level according to a fourth embodiment of the invention.
FIG. 12 is a schematic explanatory view showing a table in a memory according to the fourth embodiment of the invention.

Now, preparation of a table setting the quantity of carrier replenishment in accordance with the degree of carrier degradation will be described. The table is prepared by using a developer for which the degree of carrier degradation is confirmed in advance. First, using a developer for which the degree of carrier degradation is confirmed in advance, how many seconds it takes for the toner concentration to reach a reference concentration level after toner replenishment is started following the toner empty state. The reference concentration level is an average value of toner concentration of a developer that enables the developing device to carry out satisfactory development. FIG. 11 shows the result of measurement.

It is now assumed, for example, that the output of the toner concentration sensor 61 in the toner empty state is 3.0 V and the output of the toner concentration sensor 61 at the reference concentration level is 2.5 V. Also, the restoration time from a time point (A) to a time point (B) is expressed by (T). The time point (A) is a time point when toner replenishment is started after the toner empty state. The time point (B) is a time point when the output of the toner concentration sensor 61 restores to the reference concentration level after the start of toner replenishment. In the not used state where the carrier is not degraded, the restoration time (Tθ) of the developer is 0 to 10 seconds as indicated by dotted line θ. As the restoration time (T) is measured with a developer for which the degree of carrier degradation is confirmed as α, the restoration time (T) is 30 seconds as indicated by solid line α in FIG. 11. As the restoration time (T) is measured with a developer for which the degree of carrier degradation is confirmed as β, the restoration time (T) is 105 seconds as indicated by solid line β in FIG. 11.

Moreover, as shown in FIG. 12, when the process speed is 150 mm/s, the quantity of carrier replenishment is set to 0 if the restoration time (T) is 0 to less than 10 seconds. The quantity of carrier replenishment is set to 4 g if the restoration time (T) is 10 to less than 40 seconds. The quantity of carrier replenishment is set to 6 g if the restoration time (T) is 40 to less than 70 seconds. The quantity of carrier replenishment is set to 8 g if the restoration time (T) is 70 to less than 100 seconds. The quantity of carrier replenishment is set to 12 g if the restoration time (T) is 100 seconds or longer.

When the process speed is 75 mm/s, the quantity of carrier replenishment is set to 0 if the restoration time (T) is 0 to less than 10 seconds. The quantity of carrier replenishment is set to 6 g if the restoration time (T) is 10 to less than 40 seconds. The quantity of carrier replenishment is set to 8 g if the restoration time (T) is 40 to less than 70 seconds. The quantity of carrier replenishment is set to 10 g if the restoration time (T) is 70 to less than 100 seconds. The quantity of carrier replenishment is set to 14 g if the restoration time (T) is 100 seconds or longer. Like this, a table setting the quantity of carrier replenishment in accordance with the restoration time as shown in FIG. 12 is stored in the memory 80*a* of the CPU 80. In the color printer 1, during printing, the carrier is replenished in accordance with the degree of carrier degradation, when the first embodiment or the second embodiment is carried out. The quantity of replenishment of the carrier accordance with the quantity of the carrier replenishment set in the table in the memory 80*a*

Figure 13:
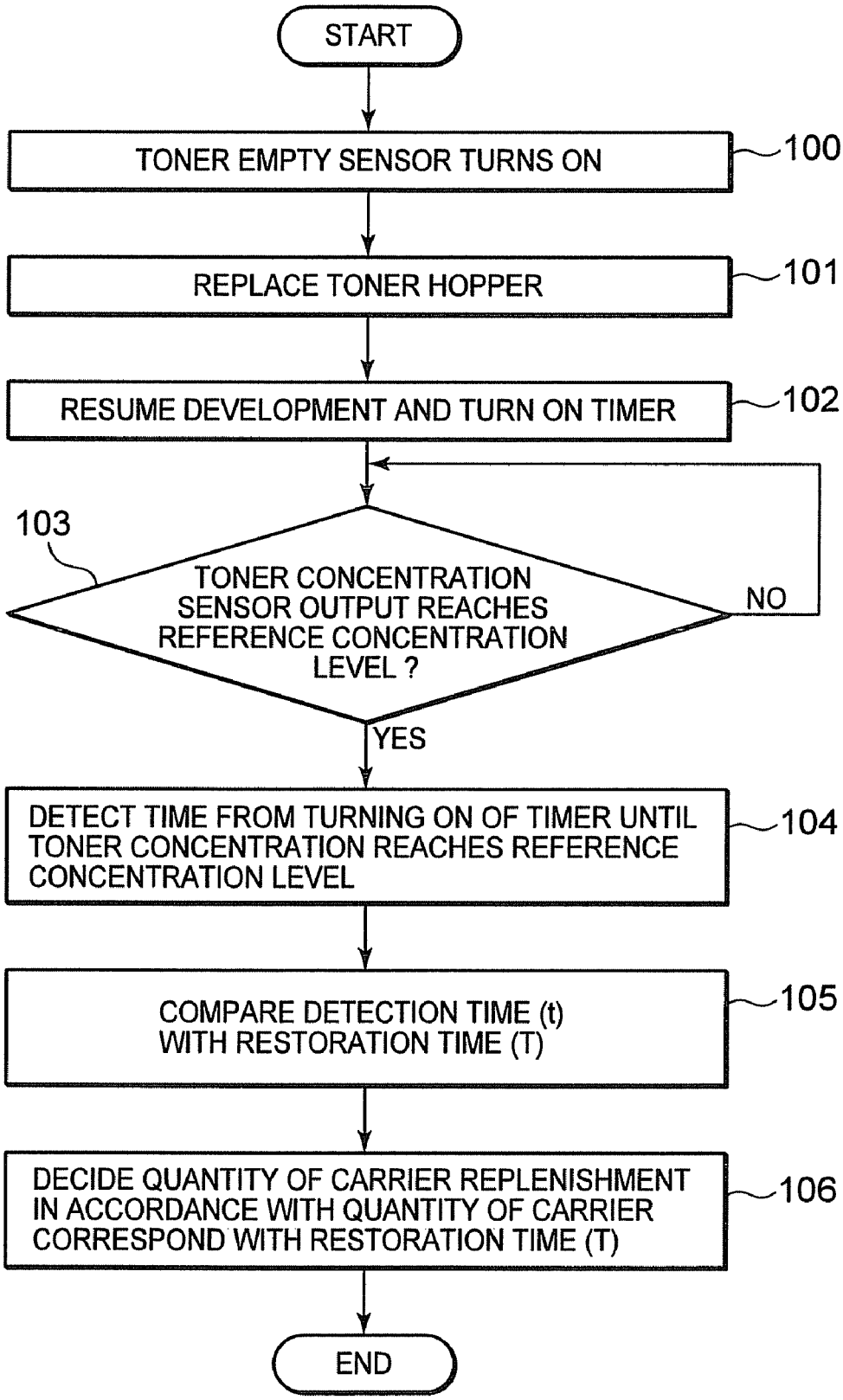
FIG. 13 is a flowchart to decide the quantity of carrier replenishment according to the fourth embodiment of the invention.

Next, a method of deciding the quantity of carrier replenishment by detecting the degree of carrier degradation in the case 50 and by referring to the table in the memory 80*a* will be described. FIG. 13 shows a flowchart. When the toner cartridge 63 becomes empty during printing, the toner empty sensor 68 turns on (Act 100), and notify to an operator that. The operator replaces the toner cartridge 63 (Act 101). After the replacement of the toner cartridge 63, an output of the toner concentration sensor 61 is detected when the next development is resumed. At the same time, the timer 83 is turned on (Act 102). This (Act 102) is equivalent to the time point (A) when toner replenishment is started after the toner empty state. The toner replenished at this time does not immediately reach the toner concentration sensor 61. Therefore, the toner concentration sensor 61 outputs the toner concentration level in the toner empty state.

After that, it is detected that the output of the toner concentration sensor 61 reaches the reference concentration level because of the toner replenishment (Act 103). When the output from the toner concentration sensor 61 reaches the reference concentration level (Yes in Act 103), the detection time (t) is detected (Act 104). The detection time (t) is time from the turning on of the timer 83 to the output of the toner concentration sensor 61 reaches the reference concentration level.

The detection time (t) corresponds to the degree of degradation of the developer 51. When the detection time (t) is long, the degree of degradation of developer 51 advances (developer 51 degrade more). The detection time (t) is inputted to the CPU 80 and compared with the restoration time (T) in the table of FIG. 12 stored in the memory 80*a* (Act 105).

The quantity of carrier replenishment in the first or the second embodiment is decided in accordance with the quantity of carrier replenishment for the restoration time (T) corresponding to the detection time (t) (Act 106). When the process speed is 150 mm/s, no carrier replenishment is done if the detection time (t) is 0 to less than 10 seconds. If the detection time (t) is 10 seconds or longer, a predetermined quantity of carrier is replenished, referring to the table stored in the memory 80*a*.

For example, in the case of the first embodiment, every time the developing roller 58 rotates 13 kilo, a predetermined quantity of carrier is replenished. Alternatively, in the case of the second embodiment, every time the number of print sheets reaches 1000, a predetermined quantity of carrier is replenished. That is, the quantity of carrier replenishment is set to 4 g if the detection time (t) is 10 to less than 40 seconds. The quantity of carrier replenishment is set to 6 g if the detection time (t) is 40 to less than 70 seconds. The quantity of carrier replenishment is set to 8 g if the detection time (t) is 70 to less than 100 seconds.

If the detection time (t) is 100 seconds or longer, it is determined that the developer in the case 50 should be replaced. The developer is replaced by a maintenance man. However, in this state, until the developer is replaced, 12 g of carrier is replenished every time the developing roller 58 rotates 13 kilo or every time the number of print sheets reaches 1000. At this time, the color printer 1 continues printing.

A threshold for degree of degradation that developer becomes not usable is defined in advance. For example, a predetermined time as the threshold for degree of degradation is defined as 130 seconds. If the detection time (t) reaches 130 seconds, it is determined that the degree of degradation of the developer is over the threshold and therefore the developer is not usable. If the degree of degradation exceeds the threshold, driving of the color printer 1 is immediately stopped.

When the process speed is 75 mm/s in Act 106, if the detection time (t) is 0 to less than 10 seconds, no carrier replenishment is done. The quantity of carrier replenishment is set to 6 g if the detection time (t) is 10 to less than 40 seconds. The quantity of carrier replenishment is set to 8 g if the detection time (t) is 40 to less than 70 seconds. The quantity of carrier replenishment is set to 10 g if the detection time (t) is 70 to less than 100 seconds. If the detection time (t) is 100 seconds or longer, it is determined that the developer should be replaced. The developer in the case 50 is replaced by a maintenance man. However, in this state, until the developer is replaced, 14 g of carrier is replenished every time the developing roller 58 rotates 13 kilo or every time the number of print sheets reaches 1000.

Thus, for example, when degradation of the carrier proceeds and the detection time (t) becomes longer, an increased quantity of carrier is replenished. However, the degree of carrier degradation is improved as the quantity of old carrier replaced by new carrier, by increase the quantity of carrier replenishment. After that, when the detection time (t) becomes shorter, the quantity of carrier replenishment is reduced in accordance with the detection time (t).

Figures 14, 15:
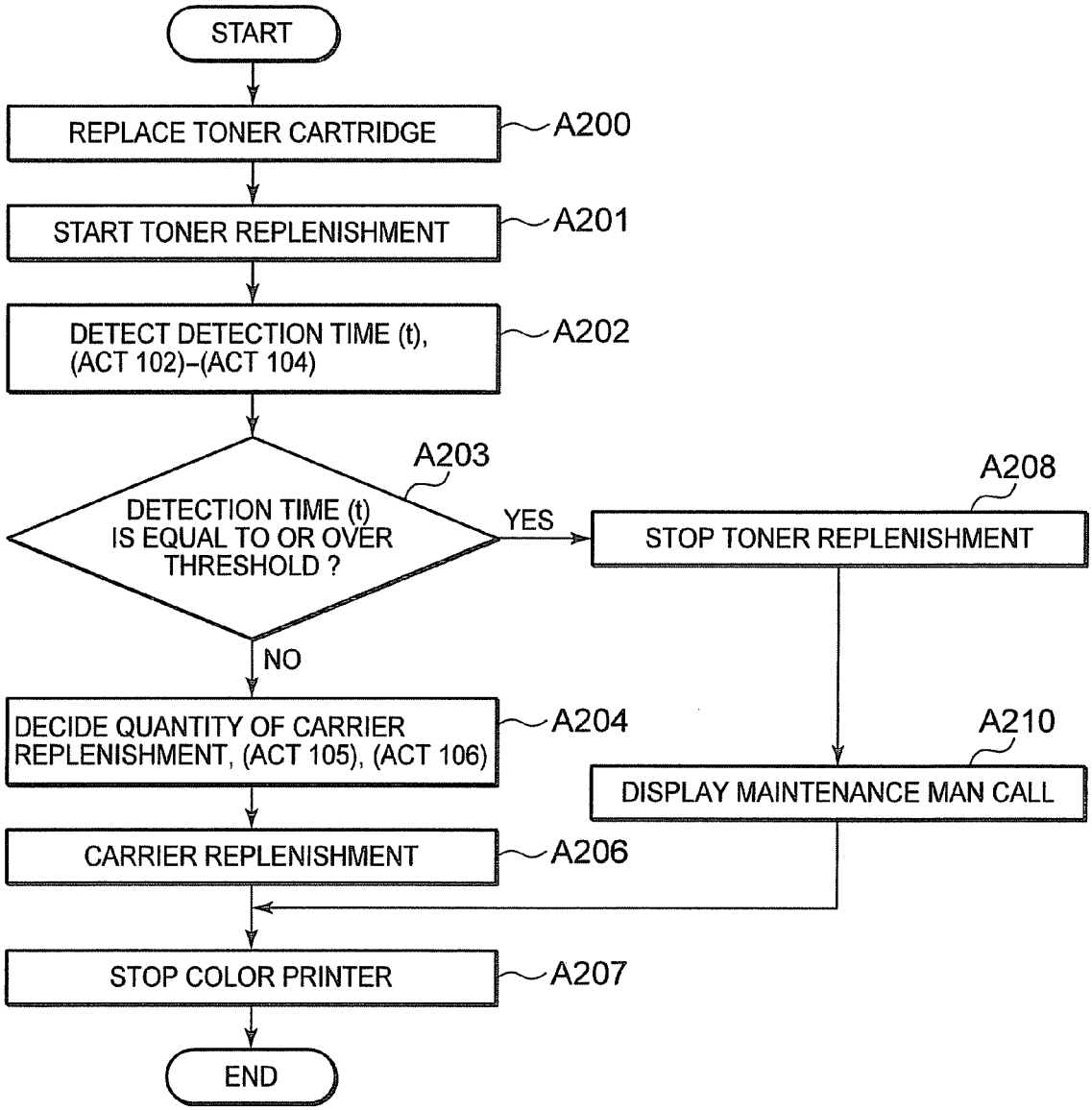
FIG. 14 is a flowchart showing processing when the degree of degradation of the developer exceeds a threshold value in the fourth embodiment of the invention.
FIG. 15 is a table showing the quantity of carrier replenishment according to a fifth embodiment of the invention.

Next, the case where the degree of degradation of the developer 51 in the case 50 is over a predetermined threshold value will be described in detail. FIG. 14 shows a flowchart. During printing, the empty toner cartridge 63 is replaced by a new toner cartridge (Act 200). Toner replenishment from the new toner cartridge 63 is started (Act 201). Acts 102 to 104 of FIG. 13 are carried out, and the detection time (t) is detected (Act 202). The detection time (t) is time from the start of toner replenishment with the new toner cartridge 63 to the toner concentration of the developer 51 to restore the reference level. The detected detection time (t) is compared with a predetermined threshold (130 seconds) (Act 203). If the detection time (t) does not reach the threshold (No in Act 203), Acts 105 and 106 of FIG. 13 are carried out to decide the quantity of carrier replenishment (Act 204). A predetermined quantity of carrier is replenished in accordance with the decided quantity of carrier replenishment (Act 206). For example, in the case of the first embodiment, a predetermined quantity of carrier is replenished every time the developing roller 58 rotates 13 kilo. Meanwhile, in the case of the second embodiment, a predetermined quantity of carrier is replenished every time the number of print sheets reaches 1000. During this time, toner is replenished from the toner cartridge 63 when necessary, and a predetermined toner concentration is thus maintained. After the end of all the printing, driving of the color printer 1 is stopped (Act 207) and the operation ends.

If the detection time (t) reaches the threshold value (Yes in Act 203), it is determined that the developer 51 in the case 50 is not usable. Toner replenishment from the toner cartridge 63 is immediately stopped (Act 208). A maintenance man call of "developer replacement" is displayed on the control panel 8 (Act 210) and driving of the color printer 1 is immediately stopped (Act 207). Thus, scattering of the developer caused by degradation of the developer is prevented.

According to the fourth embodiment, the detection time (t) until the output of the toner concentration sensor 61 reaches the reference concentration level after the toner empty state is detected and compared with the table in the memory 80*a*. The quantity of carrier replenishment is decided in accordance with the detection time (t), referring to the table. That is, the quantity of carrier replenishment is decided in addition to the quantity of carrier replenishment based on the number of rotations of the developing roller 58 in the first embodiment or the number of print sheets in the second embodiment. Therefore, the quantity of carrier replenishment can be adjusted with higher accuracy in accordance with the degree of carrier degradation. In the respective developing devices 14Y, 14M, 14C and 14K, carrier degradation in the case 50 is restrained further. The carrier can constantly maintain better properties. The toner of the developer 51 is sufficiently charged by the carrier. The respective developing devices 14Y, 14M, 14C and 14K can form better toner images. Wasteful discharge of usable carrier from the developer discharge port 53 can be prevented more securely. When the developer is degraded and becomes unusable, the color printer 1 stops immediately to prevent scattering of the developer. The stop of the color printer 1 prevents stain of the developer.

Next, a fifth embodiment of the invention will be described. In this fifth embodiment, the quantity of carrier replenishment is further adjusted in accordance with the environmental history of the developer. In this embodiment, the same configuration as the configuration described in the first embodiment is denoted by the same reference numerals and will not be described further in detail.

For example, even when carrier replenishment according to the first to the fourth embodiments is carried out, if the environment of the developer suddenly changes, the carrier replenishment may be insufficient. Generally, if the developing device is put in a low-temperature low humidity environment, toner in the developing container can be easily charged. As the quantity of toner charging increases, the bulk of the developer increases and the developer discharged from the developer discharge port 53 increases. On the contrary, if the developing device is put in a high-temperature high-humidity environment, the quantity of toner charging in the developing container decreases. As the quantity of toner charging decreases, the bulk of the developer diminishes and the developer surface falls.

Therefore, when the environment is suddenly and significantly changed from low humidity to high humidity, the developer surface falls and may cause development failure. In the fifth embodiment, the development failure due to the environmental change is prevented. Thus, when the environment is suddenly and significantly changed from low humidity to high humidity, the quantity of carrier replenishment is increased and the fall of the development surface is restrained.

For example, in the second embodiment, if the process speed is 150 mm/s, normally, the carrier is replenished at the rate of 4 g every time the number of print sheets reaches 1000, as shown in FIG. 9. However, with the fifth embodiment, the environmental history is detected and the quantity of carrier replenishment is adjusted depending on the result of detection. If the environmental history shows that the difference between the relative humidity when power is turned off on the previous day and the relative humidity when power is turned on the following day is less than 50%, carrier is replenished in the ordinary quantity of replenishment in the ordinary mode.

On the other hand, it is now assumed that the humidity detected by the temperature humidity sensor 84 when power is turned off on the previous day is 20% and that the environment suddenly changes the following day and the humidity detected by the temperature humidity sensor 84 when power is turned on is 80%. In this manner, if the environmental history shows that the difference between the relative humidity when power is turned off on the previous day and the relative humidity when power is turned on the following day is 50% or greater, the mode is switched to an increase mode and an increased quantity of carrier is replenished.

As shown in FIG. 14, in the ordinary mode and when the process speed is 150 mm/s, the quantity of carrier replenishment is 0 g in the initial state where the number of print sheets is 0 immediately after power is turned on. After that, the carrier is replenished at the rate of 4 g every time the number of print sheets printed by the color printer 1 reaches 1000. On the other hand, when the mode is switched to the increase mode, first, 12 g of carrier is replenished in the initial state where the number of print sheets is 0 immediately after power is turned on, and the bulk of the developer is thus increased. After that, the carrier is replenished at the rate of 8 g every time the number of print sheets printed by the color printer 1 reaches 1000.

When the process speed is 75 mm/s, in the ordinary mode, the quantity of carrier replenishment is 0 g in the initial state where the number of print sheets is 0 immediately after power is turned on. After that, the carrier is replenished at the rate of 6 g every time the number of print sheets printed by the color printer 1 reaches 1000. On the other hand, when the mode is switched to the increase mode, first, 16 g of carrier is replenished in the initial state where the number of print sheets is 0 immediately after power is turned on, and the bulk of the developer is thus increased. After that, the carrier is replenished at the rate of 10 g every time the number of print sheets printed by the color printer 1 reaches 1000.

In this manner, when the environmental history shows that the difference in relative humidity between the previous day and the following day is 50 or greater, carrier replenishment is continued in the increase mode. After that, power is turned off and the relative humidity is detected. Moreover, the relative humidity when power is turned on the following day is detected. If the environmental history shows that the difference between the relative humidity when power is turned off and the relative humidity when power is turned on the following day is less than 50%, the ordinary mode is restored from the increase mode and carrier is replenished. The fifth embodiment can be applied to the first, the third and the fourth embodiments, similarly to the application to the second embodiment. Also in the first, the third and the fourth embodiments, it is possible to switch the quantity of carrier replenishment between the ordinary mode and the increase mode in accordance with the environmental history.

According to the fifth embodiment, the environmental history is detected, and when the difference in relative humidity from low humidity to high humidity is 50% or greater, carrier is replenished in the increase mode. That is, in the increase mode, the carrier is first replenished in the initial state and a greater quantity of carrier than in the ordinary mode is replenished every time predetermined degradation occurs in the carrier. Thus, when the environmental history shows that the quantity of toner charging is reduced and the bulk of the developer is decreased, the bulk of the developer is compensated for by the increase in the quantity of carrier replenishment. At the same time, toner charging is facilitated by the increase in the quantity of carrier replenishment. Consequently, even when the environmental history is suddenly changed, a sudden reduction in the bulk of the developer can be alleviated and developing capability can be prevented from falling.

The invention is not limited to the above embodiments. Various modifications can be made without departing from the scope of the invention. For example, the shape and structure of the toner replenishment unit and the carrier replenishment unit, and their replenishment method are not limited. Also, the toner replenishment unit and the carrier replenishment unit may be separately arranged. The structure and content of the developing container are not limited, either. The process speed of the image forming apparatus is not limited and can be switched to multiple speeds. Moreover, the quantity of carrier replenishment in accordance with carrier degradation is not limited, either. The environmental history that allows switching between the ordinary mode and the increase mode in the fifth embodiment may take temperature difference into consideration. Also, the rate of humidity difference in considering humidity is not limited.

What is claimed is:

1. A developing device comprising:

a developing container that houses a developer including toner and carrier and discharges the developer from a discharge section;

a developing roller that supplies the developer in the developing container to an image carrier;

a toner replenishment unit that replenishes the developing container with the toner;

a carrier replenishment unit that replenishes the developing container with the carrier;

a carrying unit that stirs and carries the developer in the developing container;

a toner concentration detection unit that detects toner concentration of the developer in the developing container and detects degradation of the carrier in the developing container from a restoration state of the toner concentration; and a control unit that controls quantity of replenishment of the carrier from the carrier replenishment unit in accordance with a change in characteristics of the carrier in the developing container.

2. The device according to claim 1, wherein the carrying unit has a variable stir-carrying speed.

3. The device according to claim 1, wherein the toner concentration detection unit detects that the developer in the developing container reaches its life span.

4. An image forming apparatus comprising:

an image carrier;

a latent image forming unit that forms an electrostatic latent image on the image carrier;

a developing container that houses a developer including toner and carrier and discharges the developer from a discharge section;

a developing roller that supplies the developer in the developing container to the image carrier;

a toner replenishment unit that replenishes the developing container with the toner;

a carrier replenishment unit that replenishes the developing container with the carrier;

a carrying unit that stirs and carries the developer in the developing container;

a toner concentration detection unit that detects toner concentration of the developer in the developing container and detects degradation of the carrier in the developing container from a restoration state of the toner concentration; and a control unit that controls quantity of replenishment of the carrier from the carrier replenishment unit in accordance with a change in characteristics of the carrier in the developing container.

5. The apparatus according to claim 4, wherein the image carrier travels at plural process speeds, and the carrying unit has a variable stir-carrying speed varied in accordance with the process speed.

6. The apparatus according to claim 4, wherein when the degree of degradation of the developer in the developing container exceeds a threshold, the control unit stops driving of a body of the apparatus.

7. The apparatus according to claim 4, wherein when the degree of degradation of the developer in the developing container exceeds a threshold, the control unit controls a maintenance man call.

8. A developing method comprising:

supplying a developer including toner and carrier that is stirred and carried in a developing container, to an image carrier by using a developing roller;

detecting a change in characteristics of the carrier in the developing container from a restoration state of the toner concentration; and replenishing the developing container with new carrier in a quantity corresponding to the change in the characteristics of the carrier.

9. The method according to claim 8, wherein the developer is stirred and carried at a variable stir-carrying speed.

10. The device according to claim 1, wherein the restoration state is a restoration time that the toner concentration reaches a reference concentration level after a toner empty state.

11. The device according to claim 4, wherein the restoration state is a restoration time that the toner concentration reaches a reference concentration level after a toner empty state.

12. The method according to claim 8, wherein the restoration state is a restoration time that the toner concentration reaches a reference concentration level after a toner empty state.

* * * * *